US006648502B2

(12) United States Patent
Oomori et al.

(10) Patent No.: US 6,648,502 B2
(45) Date of Patent: Nov. 18, 2003

(54) WRIST-PORTABLE ELECTRONIC APPARATUS AND AIR CHAMBER DEVICE

(75) Inventors: Nobukazu Oomori, Chiba (JP); Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 10/100,743

(22) Filed: Mar. 18, 2002

(65) Prior Publication Data

US 2002/0173734 A1 Nov. 21, 2002

(30) Foreign Application Priority Data

Apr. 13, 2001 (JP) ..... 2001-115564

(51) Int. Cl.[7] ..... G04B 37/00

(52) U.S. Cl. ..... 368/281; 368/276; 368/278; 368/282; 368/283

(58) Field of Search ..... 368/276, 278, 368/281–283

(56) References Cited

U.S. PATENT DOCUMENTS 4,030,646 A * 6/1977 Switack et al. ..... 224/577
5,663,932 A * 9/1997 Weng ..... 368/10
6,461,125 B1 * 10/2002 Terasawa et al. ..... 417/479

* cited by examiner

*Primary Examiner*—David Martin
*Assistant Examiner*—Michael L. Lindinger
(74) *Attorney, Agent, or Firm*—Adams & Wilks

(57) ABSTRACT

A wrist-wearable electronic apparatus has a case and a band connected to the case for attaching the electronic apparatus to a wearer's wrist. A flexible expansion chamber is provided on the wrist side of the case or the band, and a pump communicates with the interior of the expansion chamber for supplying air thereto to inflate the expansion chamber so that it can be maintained in close contact with the wearer's wrist. The pump has a pair of push-in portions on opposed lateral sides of the case or band adjacent the wrist side thereof so that the wearer can apply sideways directed forces to actuate the push-in portions to supply air to the expansion chamber. A discharge valve communicates with the interior of the expansion chamber for discharging air therefrom. The pump may be rotatably mounted to enable the wearer to position the push-in portions at desired positions to facilitate actuation thereof by the wearer.

44 Claims, 15 Drawing Sheets

WRIST-PORTABLE ELECTRONIC APPARATUS AND AIR CHAMBER DEVICE

BACKGROUND OF THE INVENTION

1. Field of the Invention

This invention relates to a wrist-portable electronic apparatus and an air chamber device wherein the air chamber device is caused to expand to thereby allow the apparatus to be held in close contact with the wrist.

2. Description of the Prior Art

As a portable watch equipped with an air chamber device, a technique such as disclosed, for example, in Japanese Patent Application Laid-Open No. 2000-130342 is known. FIG. 16 is a side view showing the general construction of such a conventional portable watch 100, FIG. 17 is an enlarged perspective view showing a display portion of the watch shown in FIG. 16. FIG. 18 is a perspective view of an air chamber device 103 alone with which the conventional portable watch 100 shown in FIGS. 16 and 17 is equipped.

This portable watch 100 is equipped with a watch case 101, a watch band 102, and the air chamber device 103. The air chamber device 103 is composed of a pump portion 104, a discharge valve 105, and an expansion chamber 106. The pump portion 104 and the discharge valve 105 are provided so as to be perpendicular to the plane of the expansion chamber 106. The pump portion 104 and the discharge valve 105 are respectively inserted into reception holes 107*a* and 107*b* provided in the watch case 101 from the back side of the watch case 101 to come out on the upper surface of the watch case 101.

To fasten the portable watch 100 to the wrist, the watch band 102 is wound around the wrist, and, in this condition, a push-in portion 108 of the pump portion 104 is pressed down, whereby air is supplied to the expansion chamber 106, and the expansion chamber 106 expands to come into close contact with the wrist. To limit the number of times that the pressing down is conducted, for example, to approximately 20, the pump portion 104 must have a predetermined level of volume. Thus, the volume of the pump portion 104 is substantially determined by the volume of the expansion chamber 106.

In the air chamber device 103 with which the above-described conventional portable watch 100 is equipped, the pump portion 104 is arranged on the upper surface of the watch case 101, so there arises a problem that there is a limitation regarding the general design of the watch. Further, the direction in which the push-in portion 108 is pressed is such that the expansion of the air chamber device 103 is hindered, causing a problem of a poor efficiency.

Further, since the volume of the pump portion 104 is large, there is a problem that the size of the watch case 101 is rather large. On the other hand, there is a limitation to the reduction in the volume of the pump portion 104 since that would lead to a marked increase in the number of times that the pressing down is conducted.

SUMMARY OF THE INVENTION

This invention has been made in view of the above problems. To overcome the above problems, a wrist-portable electronic apparatus of the present invention is characterized by an expansion chamber provided on the wrist side of an apparatus case or an apparatus band, and a pump portion which supplies air to the expansion chamber and has an air push-in portion on a side portion of the apparatus case or the apparatus band.

That is, in accordance with this invention, the air push-in portion is provided on a side portion of the apparatus case or the apparatus band, which means the air push-in portion is not positioned on the upper side of the apparatus, whereby it is possible to increase the degree of freedom regarding the design of the wrist-portable electronic apparatus. Further, since the direction in which the expansion chamber expands differs from the pressing direction, the expansion can be efficiently effected. In particular, when the push-in portion is provided on a side portion of the apparatus band, it is possible to prevent an increase in the size of the apparatus case. Further, in this wrist-portable electronic apparatus, it is possible to use an air chamber device in which the pump portion has a pressing direction substantially parallel to the plane of the expansion chamber.

Further, in accordance this invention, there is provided a wrist-portable electronic apparatus characterized by an expansion chamber provided on the wrist side of an apparatus case or an apparatus band; and a pump portion which connects with the expansion chamber to supply air thereto, separably attaches a hollow pump body to the apparatus case or the apparatus band so as to be rotatable with respect to the apparatus case or the apparatus band, and has an air push-in portion on a side portion of the pump body.

That is, in this wrist-portable electronic apparatus, when supplying air to the expansion chamber, the pump body of the pump portion is rotated in a direction which facilitates pushing, with the wrist-portable electronic apparatus being attached to the wrist, and the push-in portion is pressed a plurality of times with a finger, whereby the expansion chamber expands, and the wrist-portable electronic apparatus is tightly secured to the wrist. Further, this wrist-portable electronic apparatus can adopt a construction in which the pump portion is separated from the expansion chamber and rotatably connected to the expansion chamber.

Further, a wrist-portable electronic apparatus of this invention is characterized in that the apparatus case or the apparatus band is further provided with a groove into which the pump portion is fitted; and the pump portion can be pulled out from and pushed into the apparatus case or the apparatus band, in which in the pulled-out state, the pump portion is rotatable, and in the pushed-in state, the pump portion is fitted into the groove formed in the apparatus case or the apparatus band and its rotation is prevented.

When supplying air to the air chamber device, the pump portion is first pulled out of the apparatus case or the apparatus band, with the wrist-portable electronic apparatus being attached to the wrist, and the push-in portion of the pump portion is rotated in a direction which allows the push in portion to be easily pressed to supply air. Then, when the air supply has been finished, the groove to thereby prevent the pump portion from rotating. Note that, apart from a rectangular sectional configuration, the groove may also have a semi-circular sectional configuration, etc. Further, the prevention of rotation of the pump portion by means of the groove is effected not only when the air supply is finished but also when, for example, the apparatus is not attached to the wrist, or when it is not secured in position by the expansion chamber.

Further, a wrist-portable electronic apparatus of this invention is characterized in that the expansion chamber of the wrist-portable electronic apparatus has a discharge valve for discharging the air from the interior of the expansion chamber; and the discharge valve of the expansion chamber and the push-in portion of the pump portion are externally arranged substantially at the same position, whereby in the design of the wrist-portable electronic apparatus, the influence of th air chamber device can be diminished, thereby achieving an improvement in terms of degree of freedom in design. Further, in this invention, the expansion chamber constitutes a part or all of the apparatus band of the wrist-portable electronic apparatus, whereby the construction of the wrist-portable electronic apparatus can be simplified.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

This invention will now be described in detail with reference to the drawings. Note that, this invention is not restricted to the following embodiments. Further, some of the components of the following embodiments allow changes in design by a so-called person skilled in the art.

(Embodiment 1)

Figure 1:
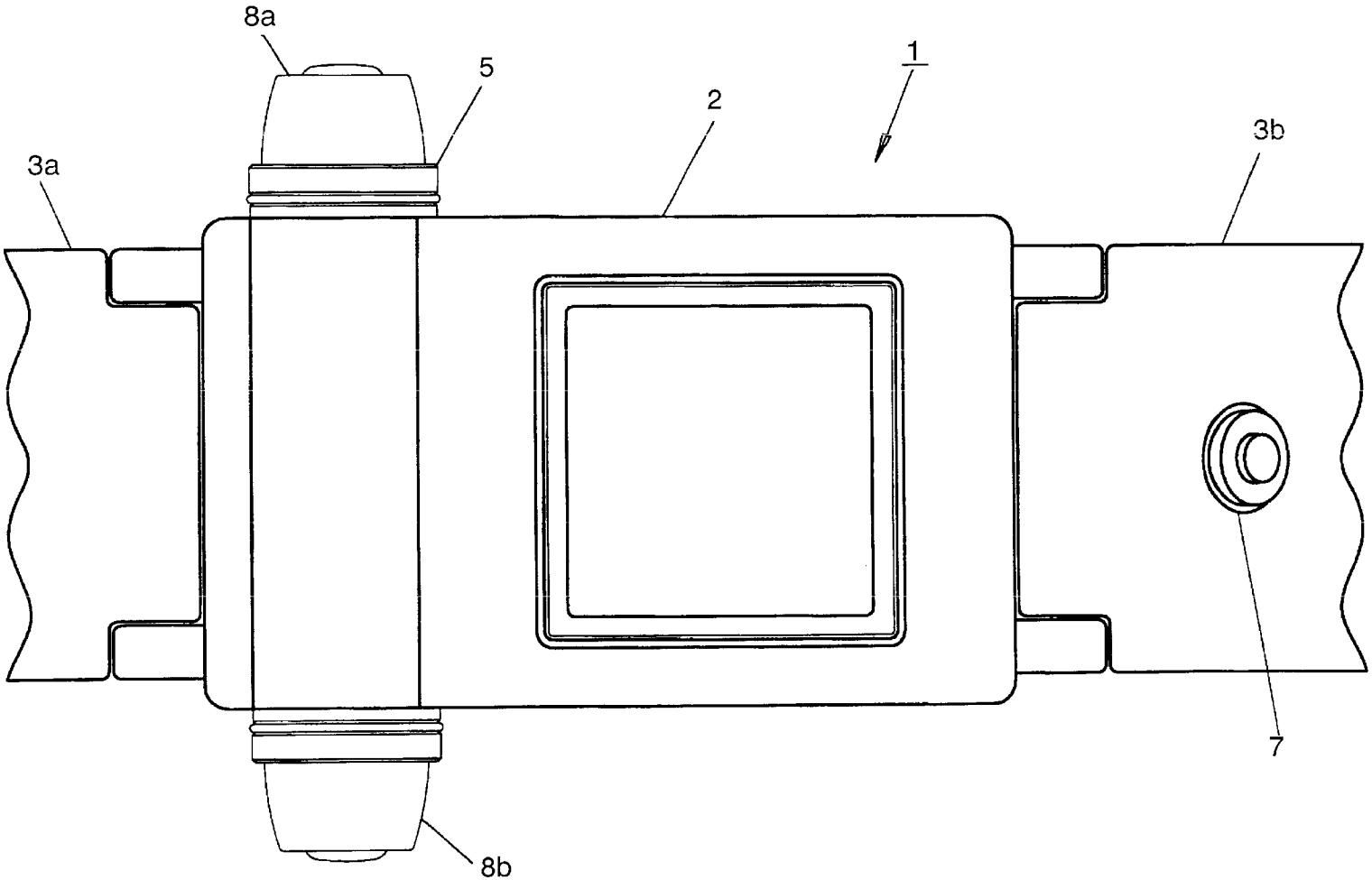
FIG. 1 is a plan view showing a portable watch according to Embodiment 1 of this invention.
Figure 2:
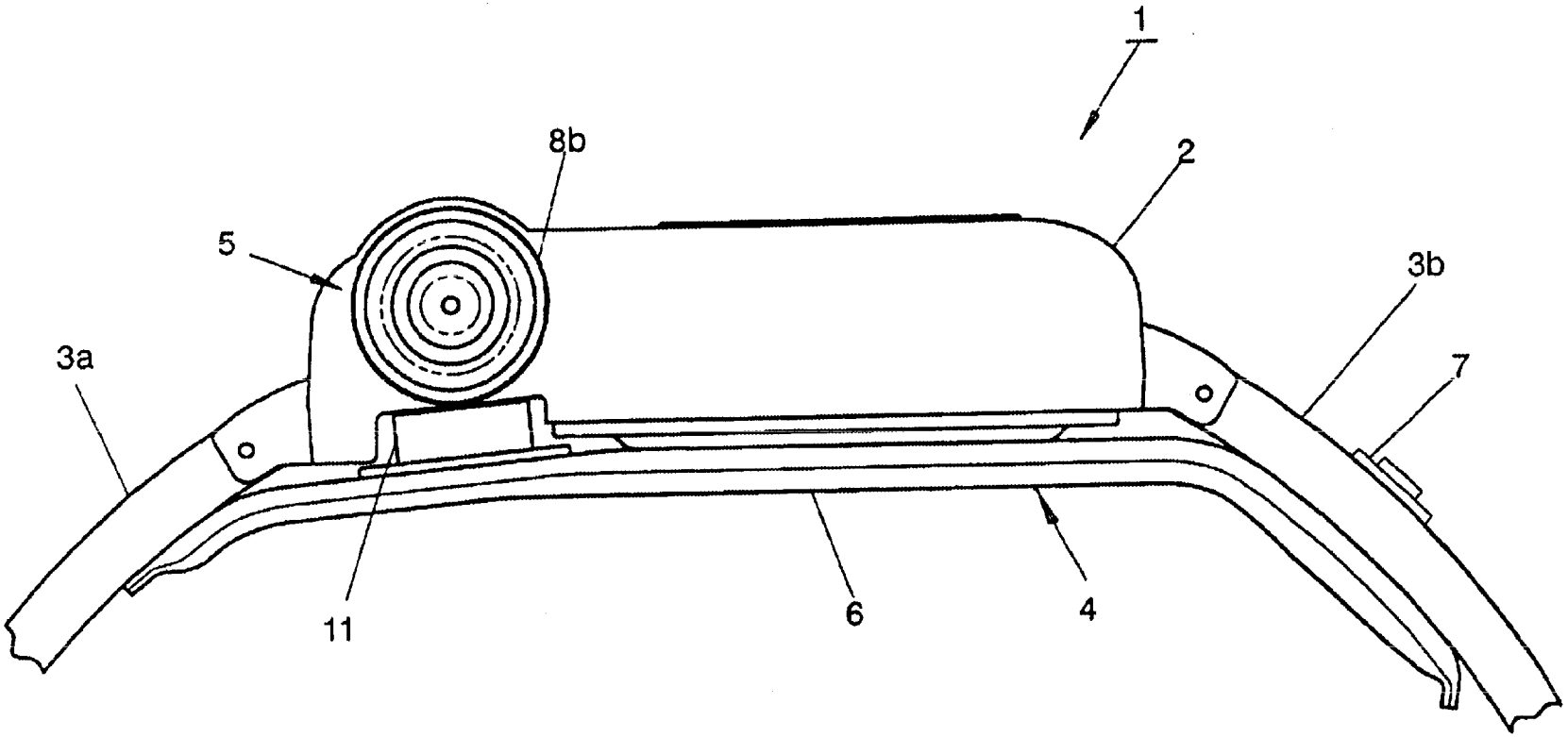
FIG. 2 is a side view and a side sectional view of the portable watch shown in FIG. 1.
Figure 3:
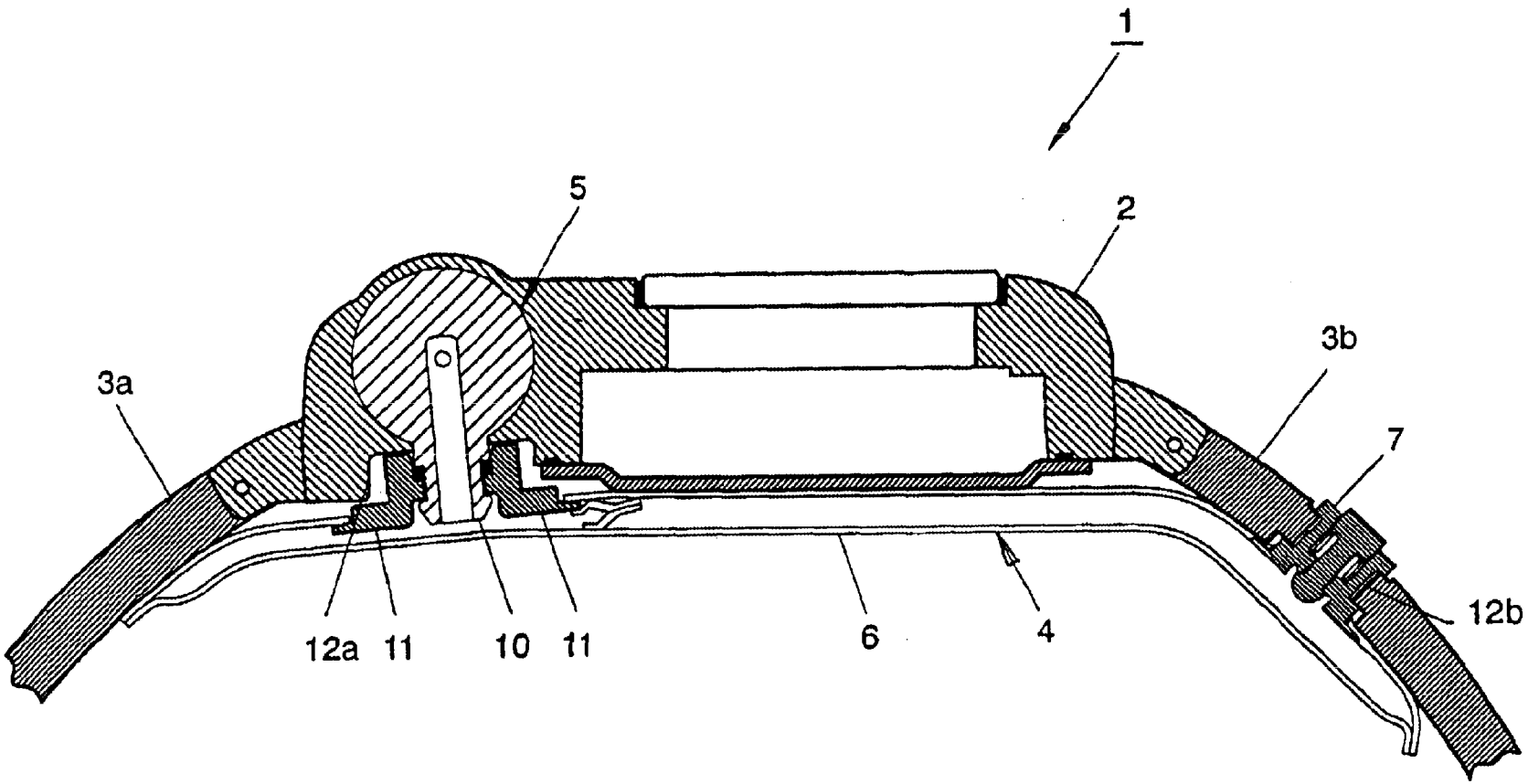
FIG. 3 is a side view and a side sectional view of the portable watch shown in FIG. 1.
Figure 4:
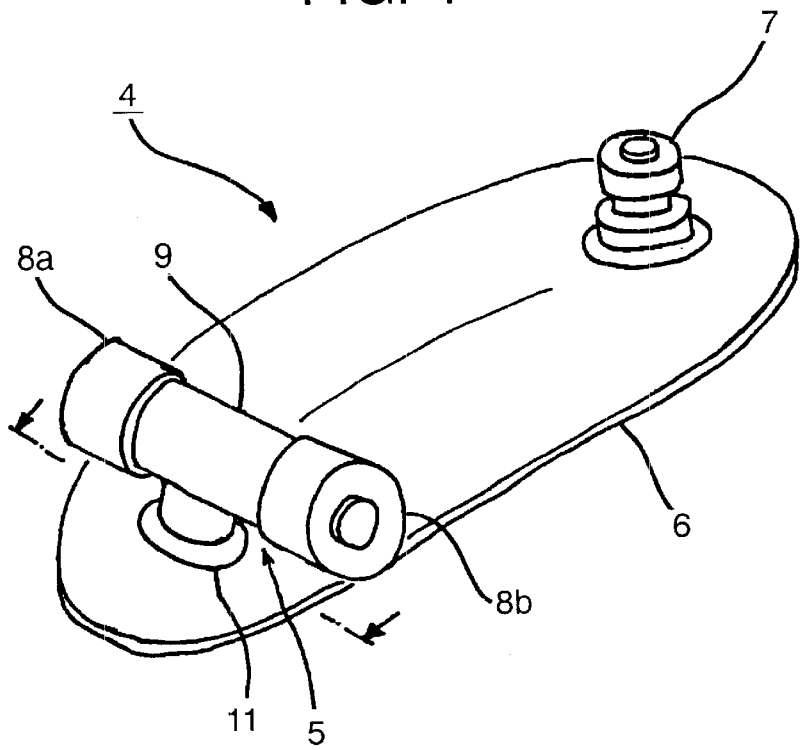
FIG. 4 is a perspective view showing an air chamber device to be incorporated into the portable watch shown in FIGS. 1 through 3.

FIG. 1 is a plan view showing a portable watch according to Embodiment 1 of this invention, and FIGS. 2 and 3 are a side view and a side sectional view of the portable watch shown in FIG. 1. FIG. 4 is a perspective view showing an air chamber device 4 incorporated in the portable watch shown in FIGS. 1 through 3, and FIG. 5 is an enlarged sectional view showing a portion around the pump portion of the air chamber device shown in FIG. 4. The portable watch 1 of Embodiment 1 is composed of a watch case 2, watch bands 3*a* and 3*b*, and an air chamber device 4 (See FIGS. 1 and 2), and the air chamber device 4 is equipped with a pump portion 5, an expansion chamber 6, and a discharge valve 7 (See FIG. 4).

The pump portion 5 is equipped with rubber push-in portions 8*a* and 8*b* each having an air introduction hole at the center of its forward end, and a cylindrical pump body 9 to the both ends of which the push-in portions 8*a* and 8*b* are mounted in a close contact state. These push-in portions 8*a* and 8*b* are used to force air into the expansion chamber 6, and they can supply approximately the same volume of air as the conventional pump portion. Further, the push-in portions 8*a* and 8*b* are arranged at both ends of the pump body 9 so that they are pressed in opposite directions. The pump body 9 is arranged substantially parallel to the surface of the expansion chamber 6, and with a nozzle 10 formed in its middle portion, is forced into and connected with a pedestal 11 provided on the expansion chamber 6. The connection between the nozzle 10 and the pedestal 11 is effected through engagement between an engagement portion ha provided on the pedestal 11 and an engagement portion 10*a* of the nozzle 10, and separation between them can be effected by pulling the nozzle in the opposite direction. Between the nozzle 10 and the pedestal 11, there is provided a packing for keeping the interior of the expansion chamber 6 hermetic.

Figure 5:
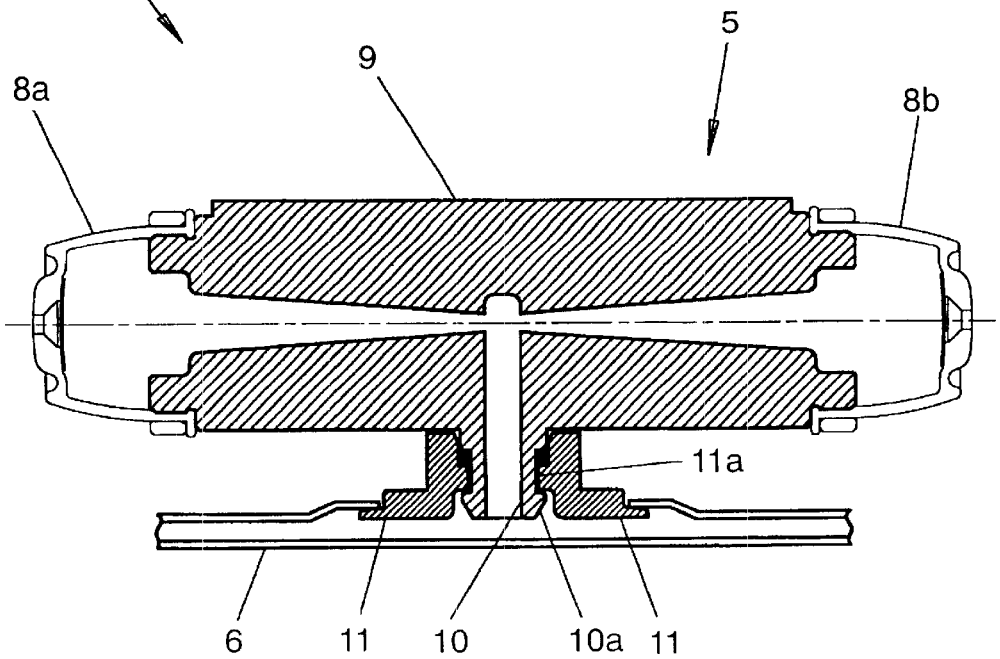
FIG. 5 is an enlarged sectional view showing a portion around the pump portion of the air chamber device shown in FIG. 4.

Further, since the pump portion 5 is formed separately from the pedestal 11, it can rotate freely with respect to the expansion chamber 6 in a plane parallel thereto (See FIG. 5). Due to this construction, the operation of incorporating the air chamber device 4 into the watch case 2 can be performed while rotating the pump portion 5, whereby the incorporation is facilitated. Further, since the pump portion 5 or the expansion chamber 6 can be individually replaced, it is possible to reduce the maintenance cost. For example, when the pump body 9 is out of order, it is only necessary to replace the pump body 9, and there is no need to replace the expansion chamber 6.

The expansion chamber 6 is formed of cloth and internally coated with rubber, its interior being divided into a plurality of air chambers(not shown). In addition, the discharge valve 7 is provided on the expansion chamber 6 so as to be perpendicular thereto. The air chamber device 4 is arranged on the wrist side of the portable watch 1 so as to extend from the watch case 2 to the watch band 3*b*. The pump portion 5 is put into the interior of the watch case 2 through a reception hole 12*a* provided on the back side of the watch case 2 and is secured therein. In the secured state, the push-in portions 8*a* and 8*b* are positioned on both the sides of the watch case 2. Also, the discharge valve 7 is inserted into a reception hole 12*b* in the 12 o'clock side watch band 3*b* and comes out on the upper surface of the watch band 3*b* to be secured in this state.

When the portable watch 1 is to be tightly worn, in the state in which the portable watch 1 is attached to the wrist by the watch band 3, the push-in portions 8*a* and 8*b* are pushed in by fingers in a pinching manner. One push causes the air in the push-in portions 8*a* and 8*b* to be supplied to the expansion chamber 6. subsequently, when the push-in portions 8*a* and 8*b* are released, air is again introduced into the push-in portions 8*a* and 8*b* through the air introduction holes. And, by pushing in the push-in portions 8*a* and 8*b* in the manner mentioned above, air is supplied to the expansion chamber 6. This pumping operation is conducted approximately fifteen times to thereby fill the expansion chamber 6 with air, whereby the expansion chamber 6 is fully expanded, and the portable watch 1 is tightly secured to the wrist.

Figure 17:
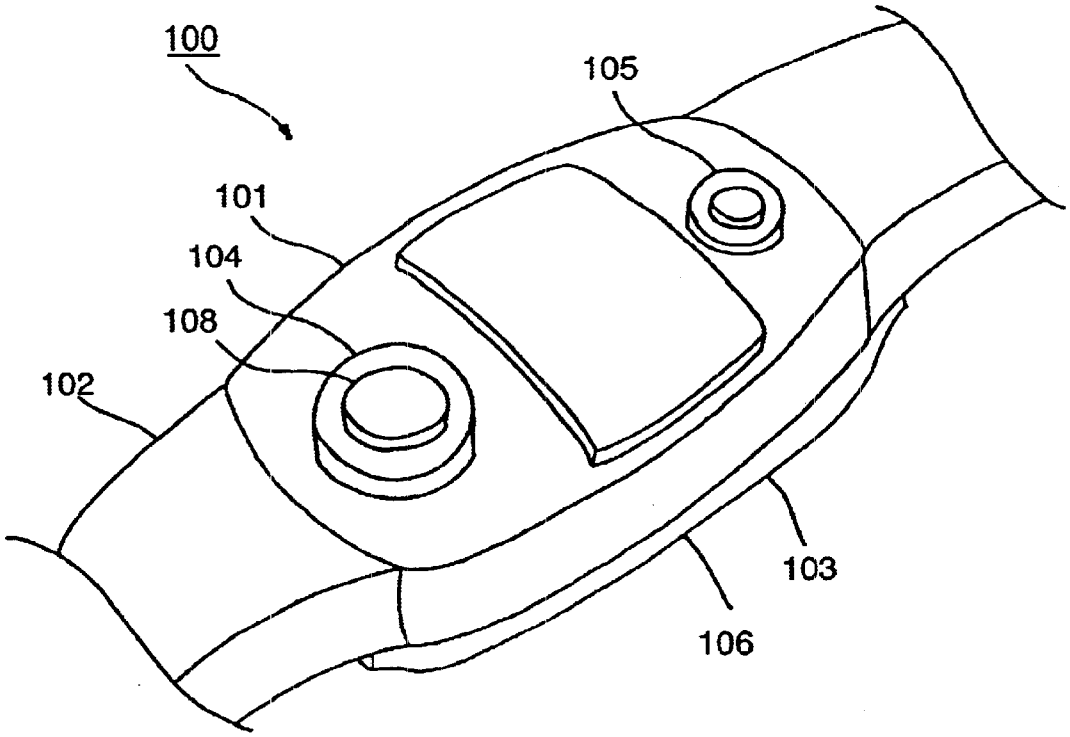
PRIOR ART FIG. 17
FIG. 17 is an enlarged perspective view showing the display portion of the watch shown in FIG. 16.
Figure 18:
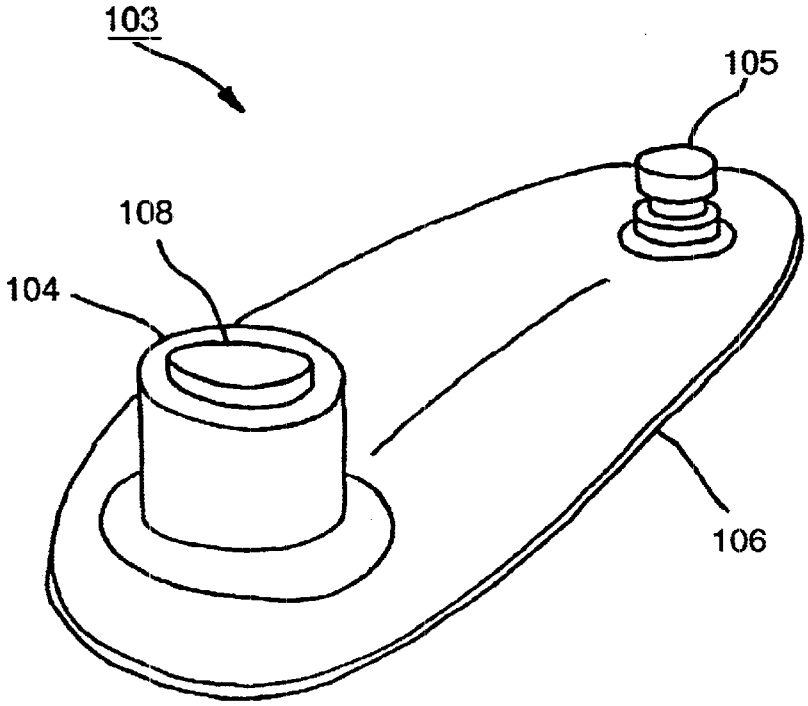
PRIOR ART FIG. 18
FIG. 18 is a perspective view of an air chamber device provided in the conventional portable watch shown in FIGS. 16 and 17.

As described above, in this portable watch 1, the expanding direction of the expansion chamber 6 differs from the pushing-in direction, so that it is possible to expand the expansion chamber 6 more efficiently as compared with the conventional portable watch 100, in which air is supplied by pressing the watch against the wrist (See FIG. 17). Further, since the push-in portions 8*a* and 8*b* are situated on the side surfaces of the watch case 2, it is possible to prevent an increase in the size of the watch case 2. Further, while in the conventional watch there is a limitation regarding design due to the fact that the push-in portion 108 is positioned in the front portion of the watch case 2, the push-in portions of this watch are provided on the side surfaces of the watch case 2, thereby enhancing the degree of freedom regarding the watch design. Further, the discharge valve 7 of the air chamber device 4 is arranged in the watch band 3*b*, whereby it is possible to further downsize the watch case 2 as compared with the conventional portable watch 100. Further, it is possible to achieve a further increase in the degree of freedom regarding design.

(Embodiment 2)

Figure 6:
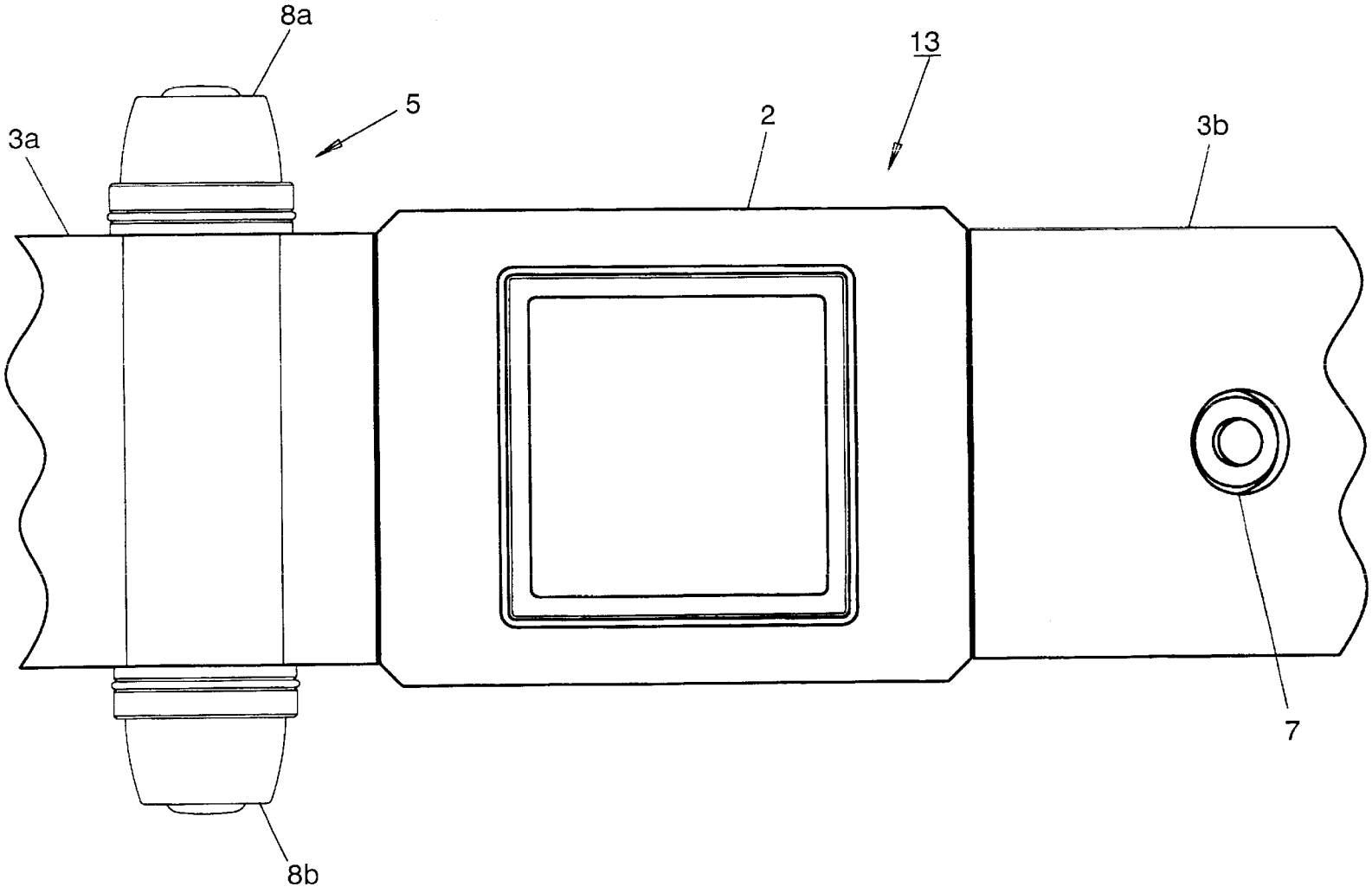
FIG. 6 is a plan view showing a portable watch according to Embodiment 2 of this invention.
Figure 7:
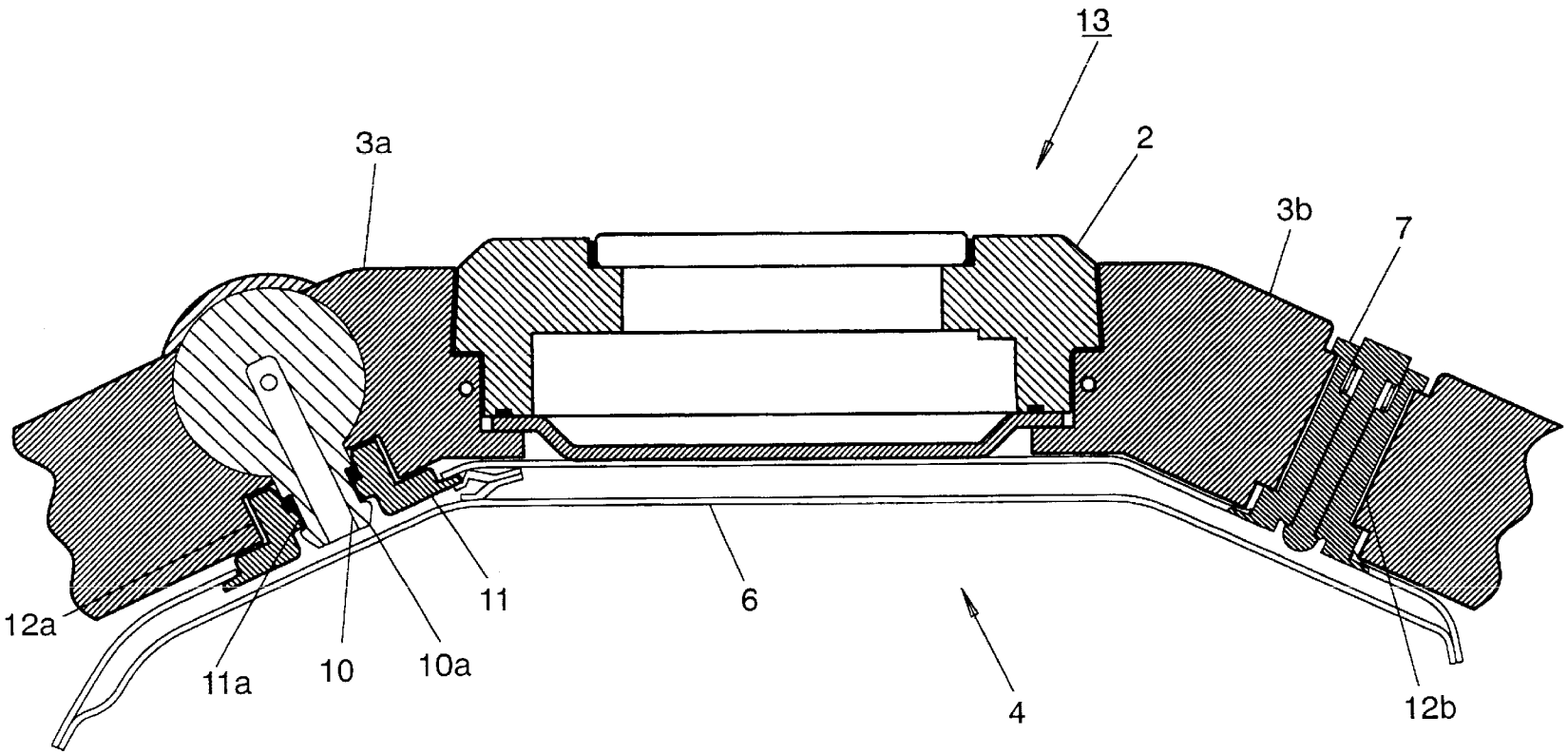
FIG. 7 is a side sectional view of the portable watch shown in FIG. 6.

FIG. 6 is a plan view showing a portable watch according to Embodiment 2 of this invention, and FIG. 7 is a side sectional view of the portable watch shown in FIG. 6. Note that, in FIGS. 6 and 7, the components which are the same as those of Embodiment 1 described above are indicated by the same symbols, and a description thereof will be omitted. The expansion chamber 6 of this air chamber device 4 is arranged on the wrist side of a portable watch 13 so as to extend from the watch band 3*a* to the watch case 2 and to the watch band 3*b*. A pump portion 5 thereof is inserted into the interior of the watch band 3*a* through the reception hole 12*a* provided in the wrist-side surface of the watch band 3*a* and is secured therein. In the inserted and secured state, its push-in portions 8*a* and 8*b* protrude from holes (not shown) provided in the side surfaces of the watch band 3*a*, allowing pushing in from the sides of the watch.

The discharge valve 7 is arranged so as to be inserted from the back side of the watch into the reception hole 12*b* provided in the watch band 3*b* and passed through the watch band 3*b* to come out on the surface of the watch band 3*b*. The portable watch 13 is worn substantially in the same manner as in the case of Embodiment 1 described above, and air is supplied to the expansion chamber 6 through pumping of the push-in portions 8*a* and 8*b* provided on the watch band 3*a*, whereby the air chamber 4 is expanded, and the portable watch 13 is tightly secured to the wrist.

As described above, in this portable watch 13, the push-in portions 8*a* and 8*b* of the pump portion 5 are respectively arranged on the watch bands 3*a* and 3*b*, so that a further increase is achieved in terms of degree of freedom in design as compared with the portable watch 1 of Embodiment 1 described above. Further, it is also possible to replace the watch case 2 separately from the air chamber device 4.

(Embodiment 3)

Figure 8:
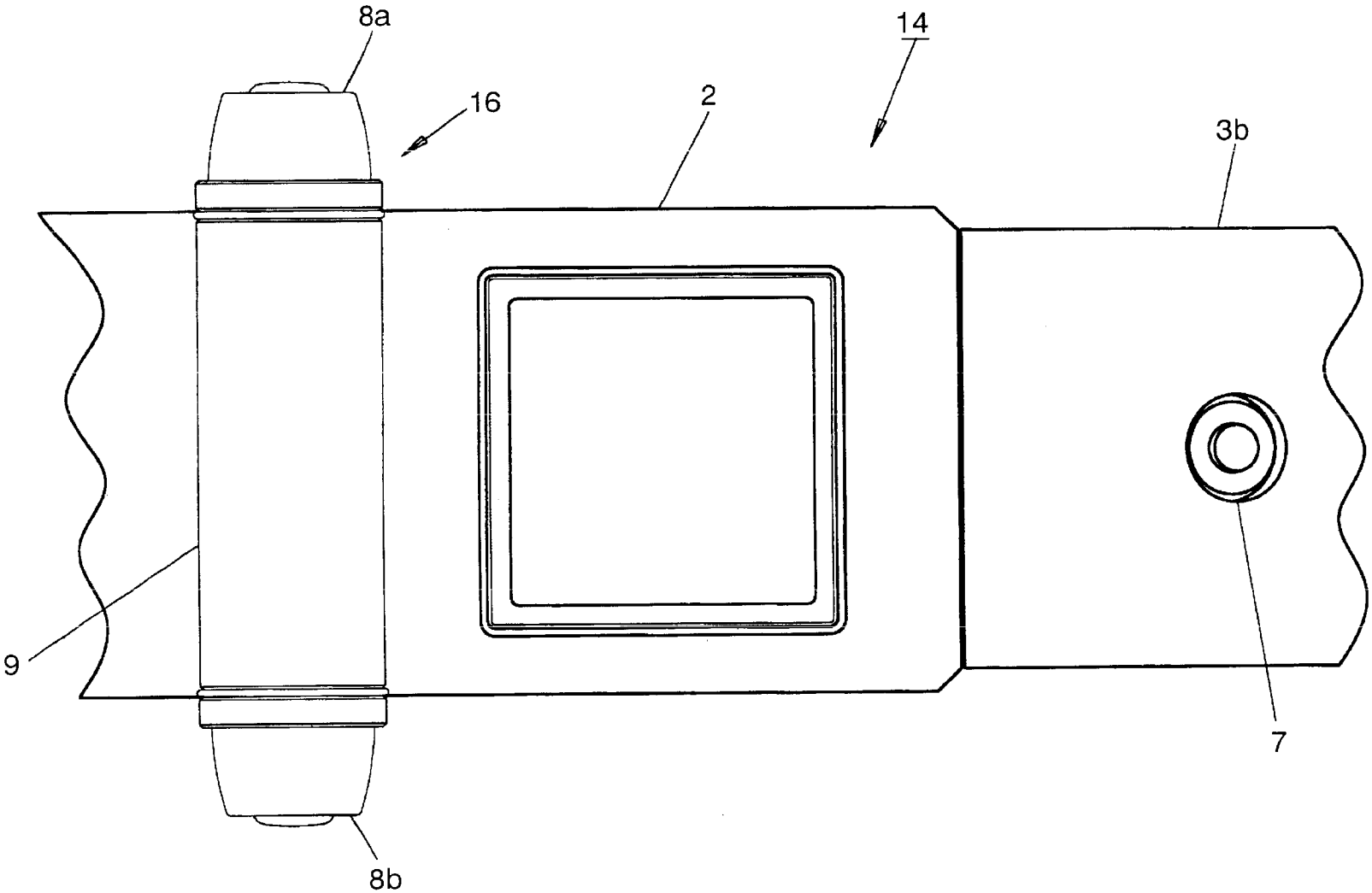
FIG. 8 is a plan view showing a portable watch according to Embodiment 3 of this invention.
Figure 9:
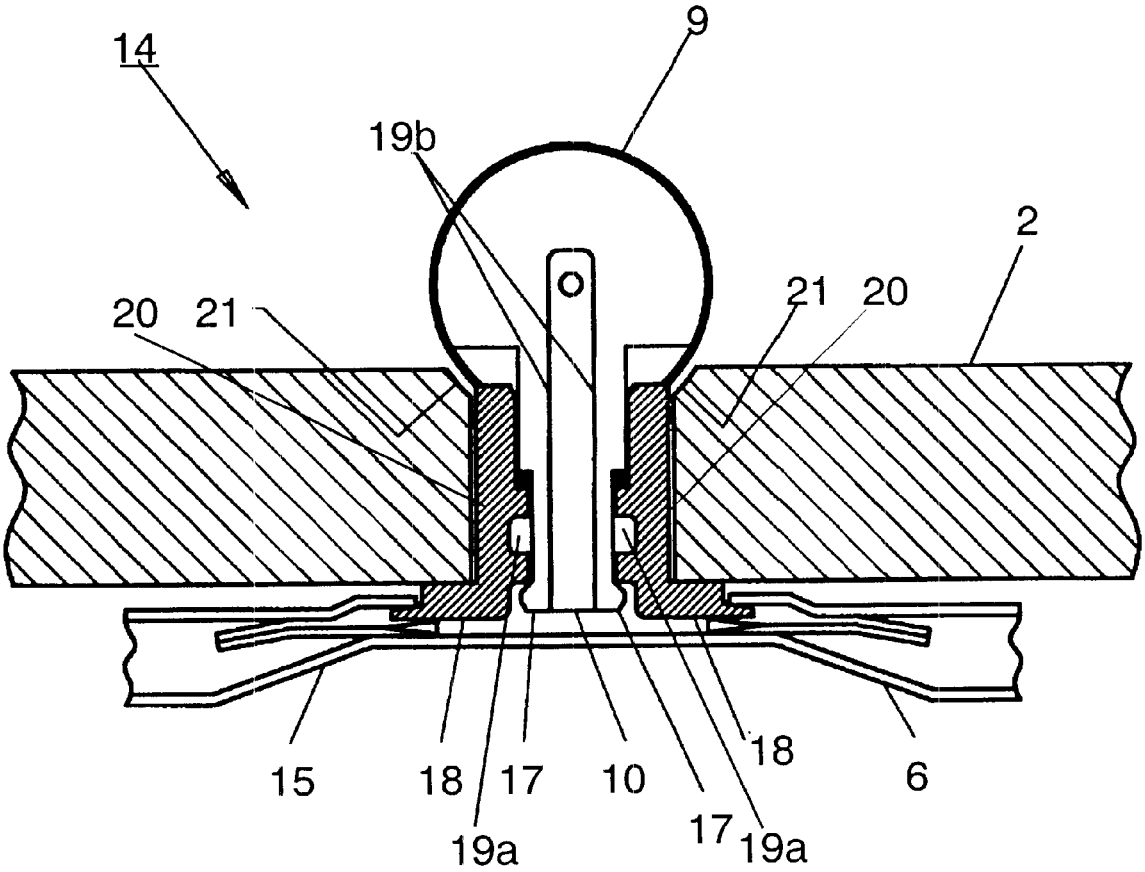
FIG. 9 is a side sectional view showing a portion around the pump portion of the portable watch shown in FIGS. 8 and 10.
Figure 10:
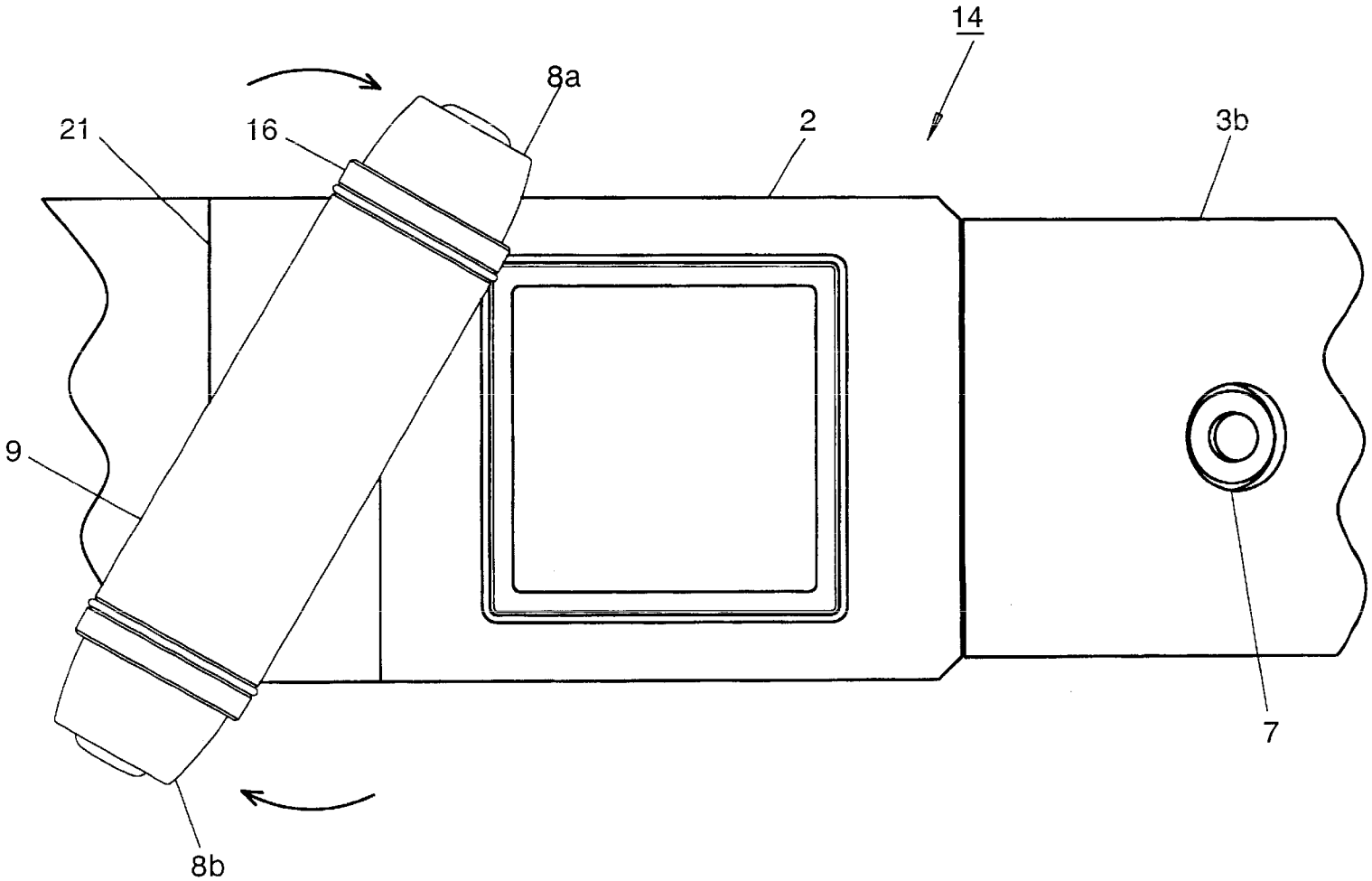
FIG. 10 is a plan view showing how air is supplied to the portable watch shown in FIG. 8.
Figure 11:
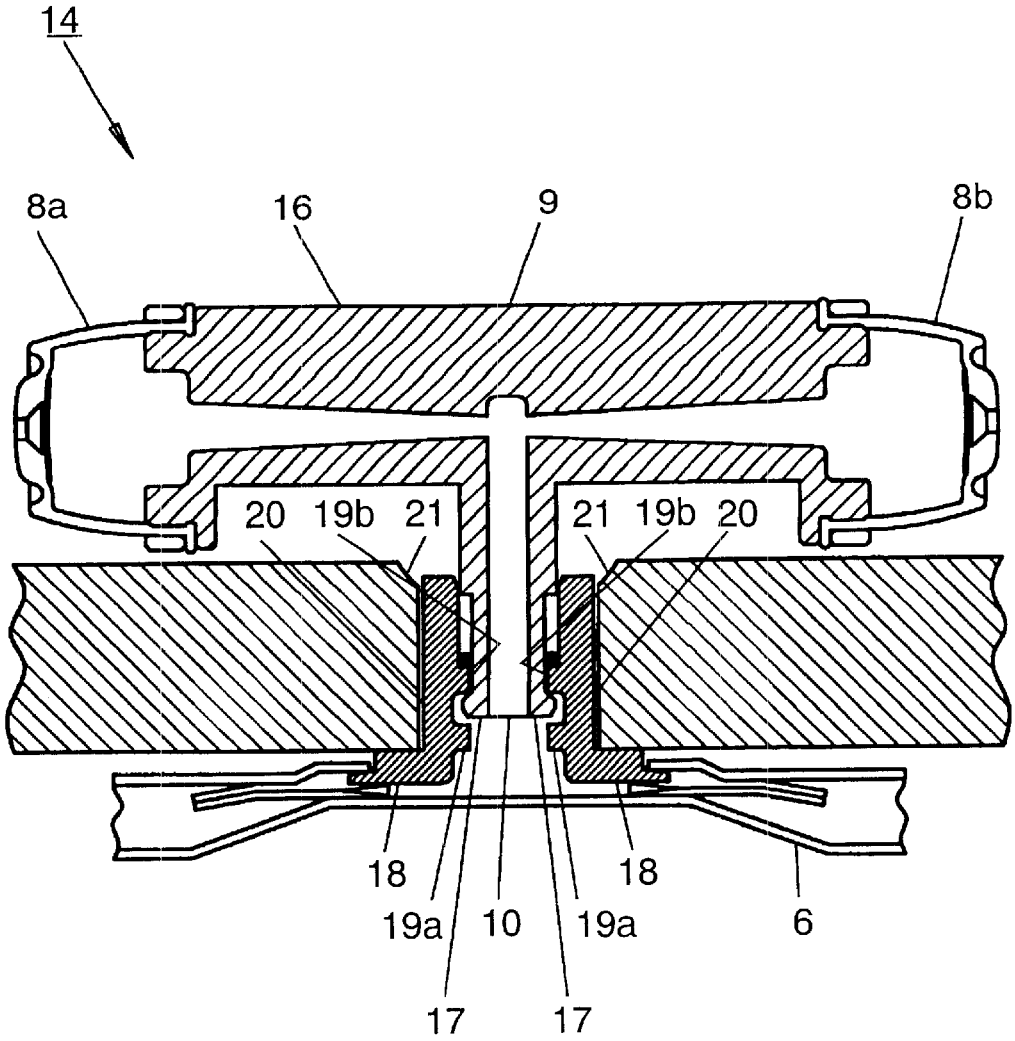
FIG. 11 is a side sectional view showing a portion around the pump portion of the portable watch shown in FIGS. 8 and 10.

FIG. 8 is a plan view of a portable watch according to Embodiment 3 of this invention, and FIG. 10 is a plan view illustrating how air is supplied to the portable watch shown in FIG. 8. FIGS. 9 and 11 are side sectional views showing a portion around the pump portion of the portable watch shown in FIGS. 8 and 10. Note that, in FIGS. 8 through 11, the components which are the same as those of Embodiment 1 described above are indicated by the same symbols, and a description of such components will be omitted.

This portable watch 14 is characterized in that the air chamber device 15 is rotatable. The pump portion 16 of the air chamber device 15 used in this portable watch 14 is equipped with the nozzle 10 formed in the middle portion of the pump body 9, and a lock portion 17 is provided at the forward end of this nozzle 10. This pump portion 16 is engaged with step portions 19*a* and 19*b* provided on the inner wall of the pedestal 18 provided on the expansion chamber 6. The lock portion 17 is movable over the step portions 19*a* and 19*b* and can be secured at the respective positions. Due to this construction, the pump portion 16 allows push-in operation and pull-out operation with respect to the pedestal 18 and can be secured at the respective positions.

Also, the pump portion 16 of the air chamber device 15 is mounted on the front side of the watch by means of a reception hole 20 provided in the watch case 2, and arranged on the front side of the watch case 2. Here, in the surface of the watch case 2, there is provided a semi-circular clearance groove 21 in conformity with the sectional configuration of the pump body 9 of the pump portion 16. Between the pump portion 16 and the pedestal 18, there is arranged an O-ring for maintaining the hermetic state. The discharge valve 7 is passed through the watch band 3*b* from the back side to come out on the front surface of the watch band 3*b*.

In the state in which it has been forced into the pedestal 18, the lock portion 17 is engaged with the step portion 19*a* of the pedestal 18, and the pump body 9 is fitted into the above-mentioned clearance groove 21, so that the pump portion 16 is constrained in rotation and secured in position. In the pulled-out state, the pump portion 16 is not constrained in rotation, and is freely rotatable with respect to the watch case 2 around the nozzle 10 (See FIG. 10).

When the portable watch 14 is worn, the above-mentioned pump portion 16 is pulled out in the state in which the portable watch 14 is attached to the wrist, and rotated in a direction which enables the push-in portions 8*a* and 8*b* to be easily pushed by fingers. And, as in Embodiment 1 described above, the push-in portions 8*a* and 8*b* are pumped a plurality of times to supply air to the expansion chamber 6, whereby the air chamber device 15 expands, and the portable watch 14 is tightly secured to the wrist.

As described above, in this portable watch 14, it is possible to rotate the push-in portions 8*a* and 8*b* in a direction which enables them to be easily pushed in the state in which the watch is attached to the wrist, so that, as compared with the portable watch 1 of Embodiment 1 described above, it is possible to expand the air chamber device 15 more efficiently. Further, when the push-in portions 8*a* and 8*b* are not to be used, the pump portion 16 is fitted into the clearance groove 21, thereby preventing inadvertent rotation.

(Embodiment 4)

Figure 12:
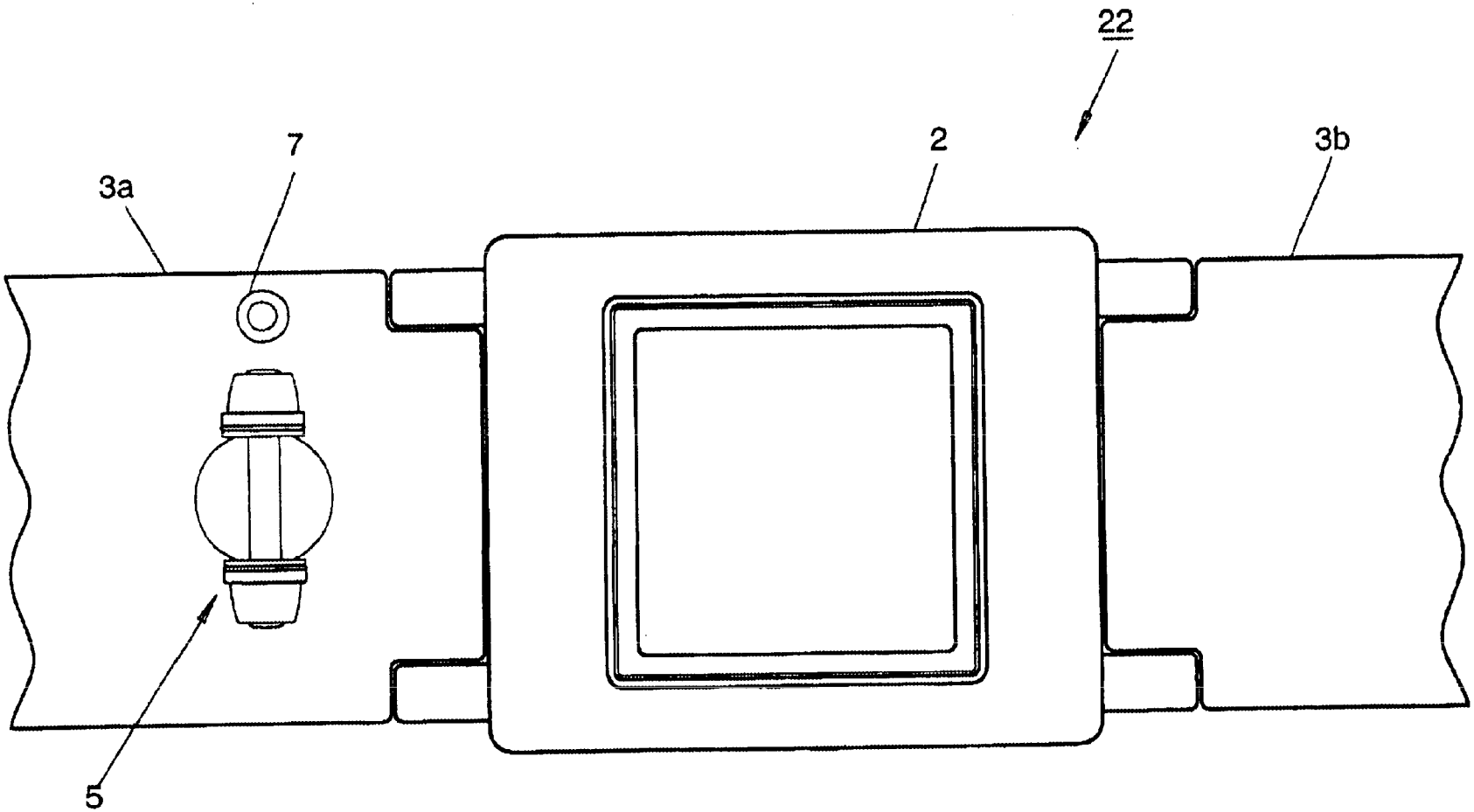
FIG. 12 is a plan view of a portable watch according to Embodiment 4 of this invention.
Figure 13:
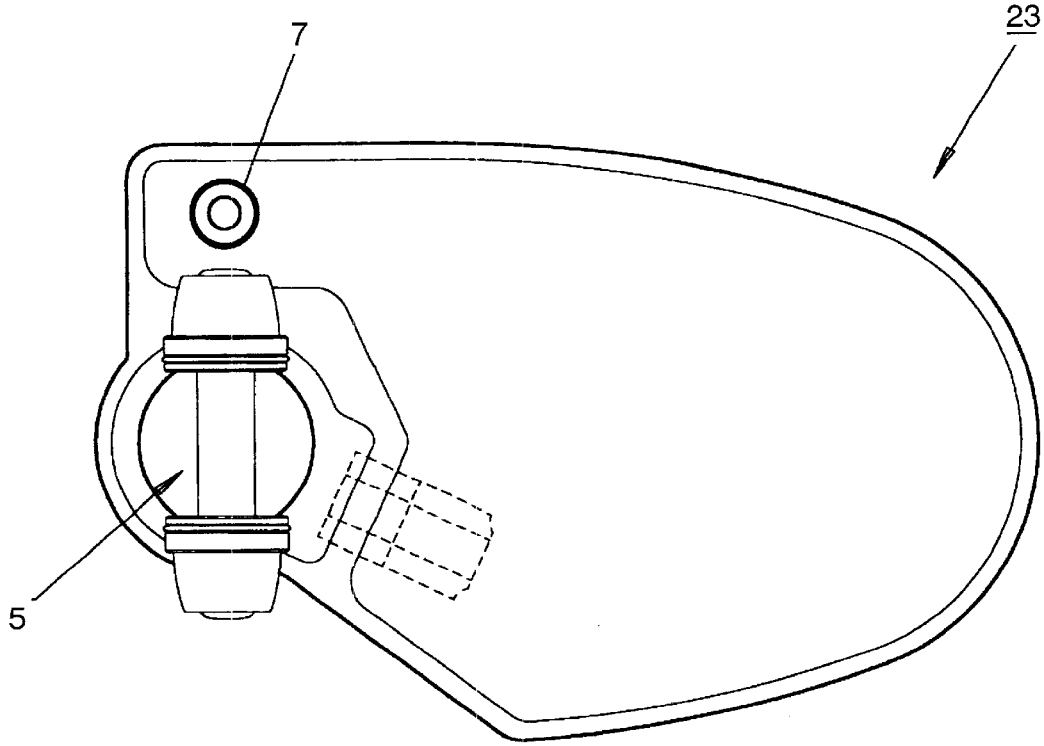
FIG. 13 is a plan view showing an air chamber device used in the portable watch shown in FIG. 12.

As shown in FIGS. 12 and 13, it is also possible to arrange the pump portion 5 and the discharge valve 7 of the portable watch 22 in close vicinity to each other on the air chamber device 23, incorporating them so as to extend from the watch band 3 to the watch case 2. Further, as in Embodiment 3 described above, the pump portion 5 is freely rotatable with respect to the watch band 3*a*. In this construction, the pump portion 5 and the discharge valve 7 are arranged substantially at the same position on the watch band 3*a*, so that the influence of the air chamber device 23 on the watch 2 in terms of design is diminished, thereby achieving an improvement in terms of degree of freedom in design. It is also possible to form the pump portion 5 and the discharge valve 7 so as to be externally integral (which is not shown).

(Embodiment 5)

Figure 14:
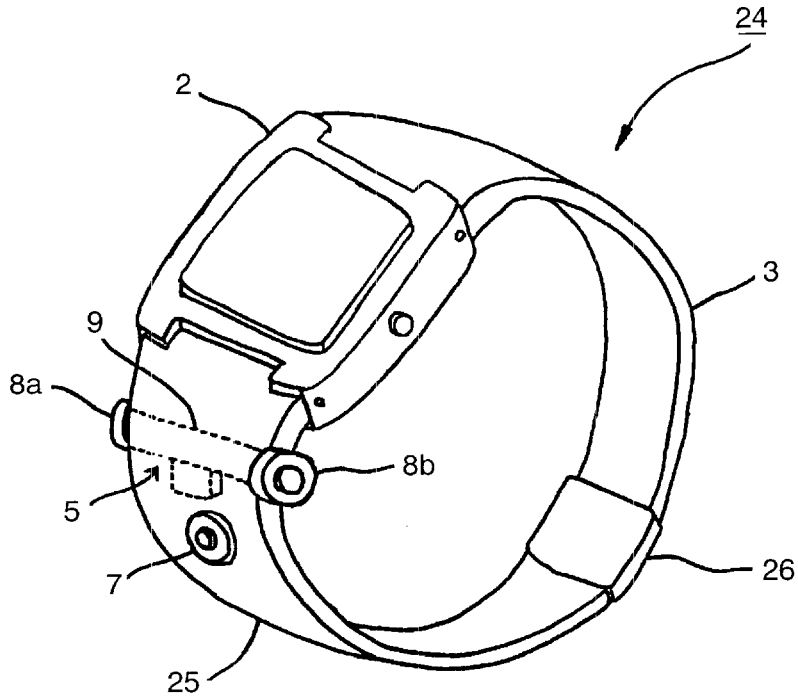
FIG. 14 is a perspective view showing the general construction of a portable watch according to Embodiment 5 of this invention.
Figure 15:
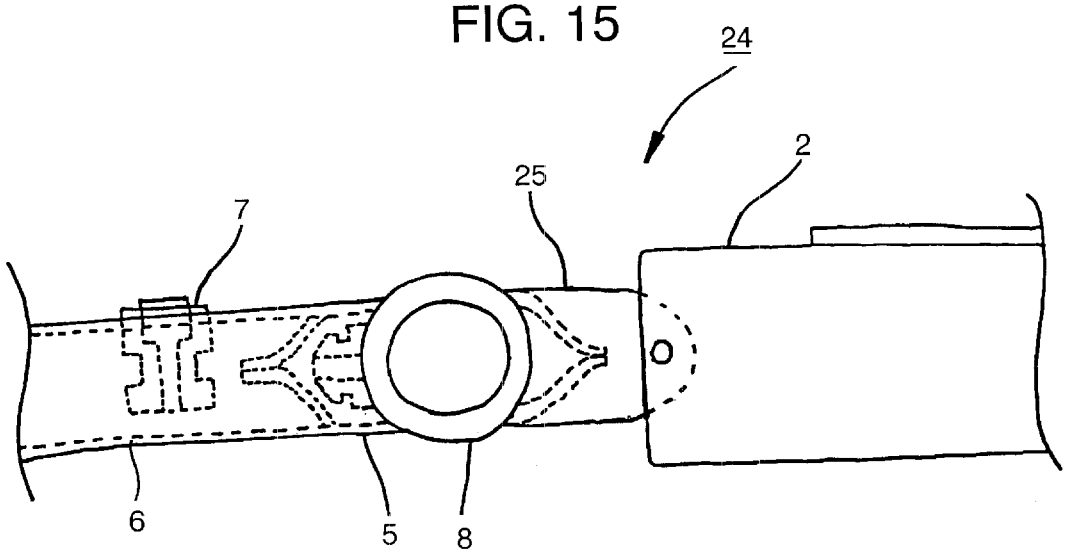
FIG. 15 is an enlarged side view showing a main portion of the portable watch shown in FIG. 14.
Figure 16:
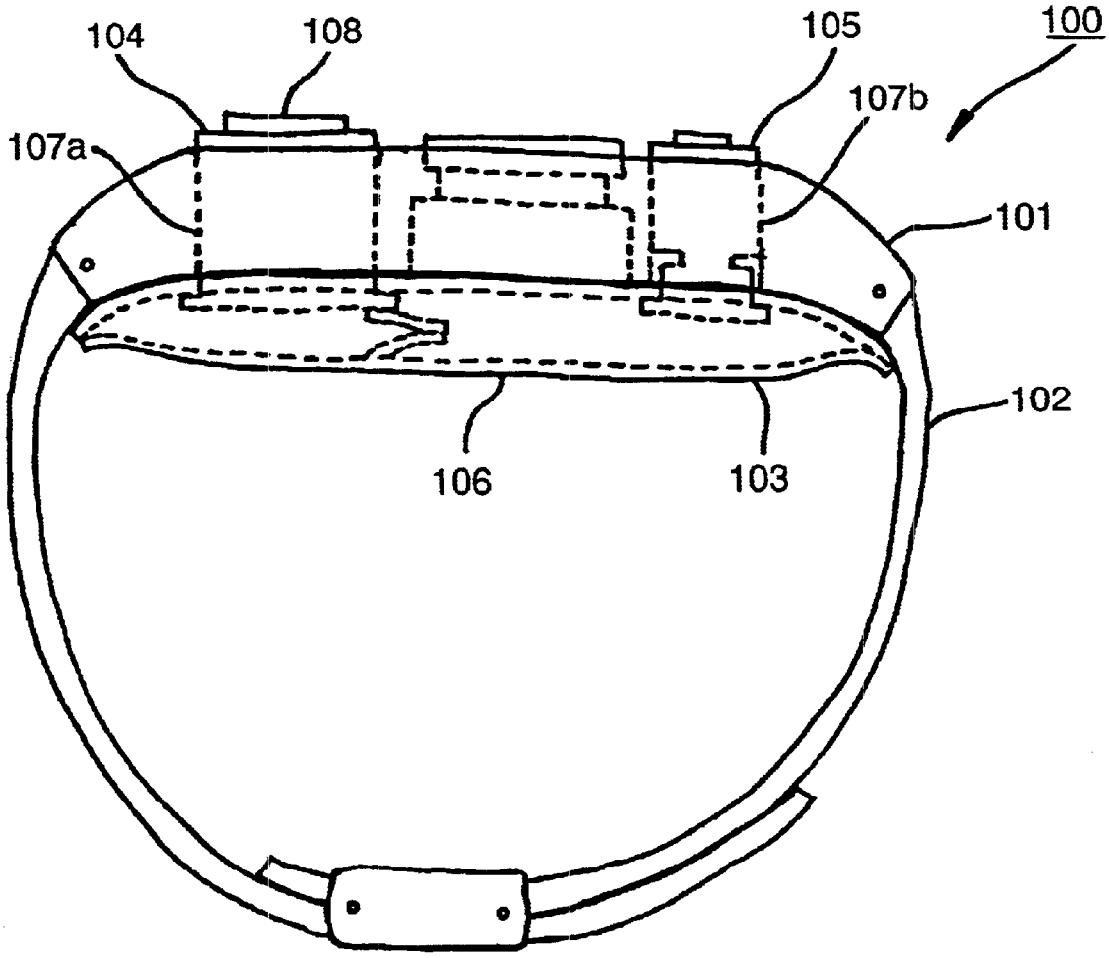
PRIOR ART FIG. 16
FIG. 16 is a side view showing the general construction of a conventional portable watch.

FIG. 14 is a perspective view showing the general construction of a portable watch according to Embodiment 5 of this invention, and FIG. 15 is an enlarged side view showing a main portion of the portable watch shown in FIG. 14. Note that, in FIGS. 14 and 15, the components which are the same as those of Embodiment 1 described above are indicated by the same symbols, and a description of such components will be omitted. The air chamber device 25 of this portable watch 24 is characterized in that it constitutes a part of the watch band. One end portion of the expansion chamber constituting the air chamber device 25 is connected to the watch case 2 by a spring bar, and the other end portion thereof is fastened to the 12 o'clock side watch band 3 by a middle fastener 26. The pump body 9 of the above-mentioned air chamber device 25 is accommodated in the interior of the expansion chamber 6, and the push-in portions 8*a* and 8*b* thereof are arranged on the side surfaces of the air chamber device 25 also serving as the watchband. Further, the expansion chamber 6 is provided with the discharge valve 7.

As in the above-described case, in this portable watch 24, the design of the watch case 2 is not constrained by the air chamber device 25, so that it is possible to develop a free design. Further, since the back surface portion of the watch is not covered with the air chamber device 25, the after maintenance is facilitated. Note that, while in the above-described construction the expansion chamber 6 constitutes a part of the watch band, it is also possible for the expansion chamber 6 to constitute the entire watch band (which is not shown).

Further, while in the above-described Embodiments 1 through 5 description has been made taking a portable watch as an example, it should not be limited to a portable watch to which the above-described construction is applied. For example, the present invention is also applicable to a wrist-portable GPS, a wrist-portable music player, a wrist-portable telephone or PHS and the like.

As described above, in accordance with this invention, the air push-in portion is provided on a side portion of an apparatus case or an apparatus band, so that it is possible to achieve an improvement in terms of degree of freedom in the design of a wrist-portable electronic apparatus. Further, since the direction in which the expansion chamber expands differs from the pushing-in direction, it is possible to effect the expansion efficiently. In particular, when the push-in portion is provided on a side portion of the apparatus band, it is possible to prevent an increase in the size of the apparatus case.

Further, in accordance with the present invention, a hollow pump body is separably connected to an apparatus case or an apparatus band so as to be rotatable, and an air push-in portion is provided on a side portion of the above-mentioned pump body, so that it is possible to rotate the push-in portion in a direction which facilitates pushing with the wrist-portable electronic apparatus being attached to the wrist, whereby the expansion of the air chamber is further facilitated.

Further, in accordance with the present invention, the pump portion can be pulled out of and pushed in the apparatus case or the apparatus band, the pump portion being rotatable in the pulled-out state; in the pushed-in state, the pump portion fits into a groove formed in the apparatus case or the apparatus band, whereby its rotation is prevented. Thus, it is possible to prevent inadvertent rotation of the rotatable pump portion provided on the above-described portable apparatus in the state in which the portable electronic apparatus is worn.

Further, in accordance with the present invention, the pump portion and the discharge valve of the expansion chamber are externally arranged substantially at the same position, so that the design of such a portable electronic apparatus is less affected, making it possible to enhance the degree of freedom in its design.

Further, in accordance with the present invention, the expansion chamber constitutes a part or all of the apparatus band, so that the design of the portable electronic apparatus is not constrained, thus achieving an improvement in terms of degree of freedom in design. Further, since the air chamber device is not arranged inside the apparatus case, it is possible to achieve a reduction in the size of the apparatus case.

Further, in the air chamber device in accordance with the present invention, the push-in portions of the pump portion are arranged so as to be horizontal with respect to the expansion chamber, so that it is possible to press the push-in portions with fingers in a pinching manner, with the apparatus being attached to the wrist. Thus, as compared with the conventional vertical arrangement, the pushing operation is facilitated.

Further, in the air chamber device in accordance with the present invention, the pump portion is rotatably connected, so that it is possible to rotate the push-in portion of the pump portion to a position where pushing is easier.

What is claimed is:

1. A wrist-portable electronic apparatus comprising:

an expansion chamber provided on the wrist side of an apparatus case or an apparatus band; and a pump portion which supplies air to the expansion chamber and has an air push-in portion on a lateral side portion of the apparatus case or apparatus band between opposed front and wrist sides thereof.

2. A wrist-portable electronic apparatus comprising:

an expansion chamber provided on the wrist side of an apparatus case or an apparatus band; and a pump portion which connects with the expansion chamber to supply air thereto, separably attaches a hollow pump body to the apparatus case or the apparatus band so as to be rotatable with respect to the apparatus case or apparatus band, and has an air push-in portion on a side portion of the pump body.

3. A wrist-portable electronic apparatus according to claim 2, wherein the apparatus case or apparatus band is further provided with a groove into which the pump portion is fitted; and the pump portion can be pulled out from and pushed into the apparatus case or apparatus band, in which in the pulled-out state, the pump portion is rotatable, and in the pushed-in state, the pump portion is fitted into the groove formed in the apparatus case or apparatus band and its rotation is prevented.

4. A wrist-portable electronic apparatus according to claim 1, wherein the expansion chamber has a discharge valve for discharging the air in the interior; and the discharge valve of the expansion chamber and the push-in portion of the pump portion are externally arranged substantially at the same position.

5. A wrist-portable electronic apparatus according to claim 2, wherein the expansion chamber has a discharge valve for discharging the air in the interior; and the discharge valve of the expansion chamber and the push-in portion of the pump portion are externally arranged substantially at the same position.

6. A wrist-portable electronic apparatus according to claim 1, wherein the expansion chamber constitutes a part or all of the apparatus band.

7. A wrist-portable electronic apparatus according to claim 2, wherein the expansion chamber constitutes a part or all of the apparatus band.

8. An air chamber device comprising:

an expansion chamber which is flat or rectangular and which can be provided on the wrist side of a wrist-portable electronic apparatus; and a pump portion and a discharge valve which are provided in the expansion chamber;

wherein the pump portion includes an air push-in portion having a push-in direction substantially parallel to the plane of the expansion chamber.

9. An air chamber device according to claim 8, wherein the pump portion is separable from the expansion chamber and is rotatably connected to the expansion chamber.

10. In a wrist-wearable electronic apparatus having a case and a band connected to the case for attaching the electronic apparatus to a wearer's wrist: a flexible expansion chamber provided on the wrist side of the case or the band; and a pump communicating with the interior of the expansion chamber for supplying air thereto to inflate the expansion chamber so that it can be maintained in close contact with the wearer's wrist, the pump having at least one actuatable push-in portion on at least one of two opposed lateral sides of the case or band adjacent the wrist side thereof so that the wearer can apply a sideways directed force to actuate the push-in portion to supply air to the expansion chamber.

11. A wrist-wearable electronic apparatus according to claim 10; wherein the pump has two push-in portions located on respective ones of the two opposed lateral sides of the case or band.

12. A wrist-wearable electronic apparatus according to claim 11; wherein the two push-in portions are on the case.

13. A wrist-wearable electronic apparatus according to claim 12; wherein the expansion chamber is provided on the case.

14. A wrist-wearable electronic apparatus according to claim 11; wherein the two push-in portions are on the band.

15. A wrist-wearable electronic apparatus according to claim 14; wherein the expansion chamber is provided on the case.

16. A wrist-wearable electronic apparatus according to claim 11; further including a discharge valve communicating with the interior of the expansion chamber for discharging air therefrom.

17. A wrist-wearable electronic apparatus according to claim 16; wherein the discharge valve is on the band.

18. A wrist-wearable electronic apparatus according to claim 16; wherein the discharge valve and the two push-in portions are on the band.

19. A wrist-wearable electronic apparatus according to claim 18; wherein the discharge valve is on the band next to the two push-in portions.

20. A wrist-wearable electronic apparatus according to claim 11; wherein the flexible expansion chamber comprises at least part of the band.

21. A wrist-wearable electronic apparatus according to claim 10; wherein the push-in portion is on the case.

22. A wrist-wearable electronic apparatus according to claim 21; wherein the expansion chamber is provided on the case.

23. A wrist-wearable electronic apparatus according to claim 10; wherein the push-in portion is on the band.

24. A wrist-wearable electronic apparatus according to claim 23; wherein the expansion chamber is provided on the case.

25. A wrist-wearable electronic apparatus according to claim 10; wherein the flexible expansion chamber comprises at least part of the band.

26. A wrist-wearable electronic apparatus according to claim 10; further including a discharge valve communicating with the interior of the expansion chamber for discharging air therefrom.

27. A wrist-wearable electronic apparatus according to claim 26; wherein the discharge valve is on the band.

28. A wrist-wearable electronic apparatus according to claim 26; wherein the discharge valve and the push-in portion are on the band.

29. In a wrist-wearable electronic apparatus having a case and a band connected to the case for attaching the electronic apparatus to a wearer's wrist: a flexible expansion chamber provided on the wrist side of the case or the band; and a pump communicating with the interior of the expansion chamber for supplying air thereto to inflate the expansion chamber so that it can be maintained in close contact with the wearer's wrist, the pump having at least one actuatable push-in portion rotatably mounted on the case or band so that the wearer can rotate the push-in portion to a desired position and apply a force thereto to actuate the push-in portion to supply air to the expansion chamber.

30. A wrist-wearable electronic apparatus according to claim 29; wherein the push-in portion is separable from the case or band to enable removal and replacement thereof.

31. A wrist-wearable electronic apparatus according to claim 29; wherein the pump has a hollow pump body rotatably mounted on the case or band, the push-in portion being provided on the hollow pump body.

32. A wrist-wearable electronic apparatus according to claim 31; wherein the case or band has a recessed portion in a front side thereof opposite the wrist side, and the hollow pump body is displaceable by the wearer between a pushed-in state wherein the hollow pump body sits in the recessed portion and is prevented from being rotated and a pulled-out state wherein the hollow pump body extends outwardly of the recessed portion and can be rotated by the wearer.

33. A wrist-wearable electronic apparatus according to claim 31; wherein the pump has two push-in portions provided, respectively, on opposite sides of the hollow pump body.

34. A wrist-wearable electronic apparatus according to claim 33; wherein the pump is mounted on the case.

35. A wrist-wearable electronic apparatus according to claim 33; wherein the pump is mounted on the band.

36. A wrist-wearable electronic apparatus according to claim 35; further including a discharge valve communicating with the interior of the expansion chamber for discharging air therefrom, the discharge valve being located on the band.

37. A wrist-wearable electronic apparatus according to claim 31; wherein the pump is mounted on the case.

38. A wrist-wearable electronic apparatus according to claim 31; wherein the pump is mounted on the band.

39. A wrist-wearable electronic apparatus according to claim 38; further including a discharge valve communicating with the interior of the expansion chamber for discharging air therefrom, the discharge valve being located on the band.

40. A wrist-wearable electronic apparatus according to claim 29; further including a discharge valve communicating with the interior of the expansion chamber for discharging air therefrom, the discharge valve being located on the band.

41. An air chamber device for use with a wrist-wearable electronic apparatus, the air chamber device comprising: a flexible, inflatable expansion chamber having a generally flat configuration and being configured to fit on the wrist side of a wrist-wearable electronic apparatus; a pump for supplying air to the expansion chamber, the pump having at least one push-in portion having a push-in direction generally parallel to the plane of the expansion chamber; and a discharge valve for discharging air from the expansion chamber.

42. An air chamber device according to claim 41; wherein the pump has two push-in portions located opposite one another and facing outwardly in opposite directions to enable a wearer of the wrist-wearable electronic apparatus to simultaneously press inwardly the two push-in portions using two fingers of one hand.

43. An air chamber device according to claim 42; wherein the pump is rotatably and separably connected to the expansion chamber.

44. An air chamber device according to claim 41; wherein the pump is rotatably and separably connected to the expansion chamber.

* * * * *